US007578303B2

(12) United States Patent
Daume et al.

(10) Patent No.: US 7,578,303 B2
(45) Date of Patent: Aug. 25, 2009

(54) DEVICE FOR AND A METHOD OF ADDING RINSE AIDS TO A HOME APPLIANCE CONTAINING LIQUIDS

(75) Inventors: Christian Daume, Burgthann (DE); Stefan Fueglein, Nuremberg (DE); Klaus-Martin Forst, Nuremberg (DE)

(73) Assignee: Electrolux Home Products N.V., Zaventem (BG)

( * ) Notice: Subject to any disclaimer, the term of this patent is extended or adjusted under 35 U.S.C. 154(b) by 549 days.

(21) Appl. No.: 11/003,802

(22) Filed: Dec. 3, 2004

(65) Prior Publication Data

US 2005/0155633 A1 Jul. 21, 2005

(30) Foreign Application Priority Data

Jan. 15, 2004 (EP) ..... 04000673

(51) Int. Cl.
*B08B 3/00* (2006.01)

(52) U.S. Cl. ..... 134/94.1; 134/58 D; 134/93; 134/200; 222/651; 222/652

(58) Field of Classification Search ..... None
See application file for complete search history.

(56) References Cited

U.S. PATENT DOCUMENTS

| | | | | |
|---|---|---|---|---|
| 2,711,178 | A * | 6/1955 | Sharp | 134/56 D |
| 2,969,072 | A | 1/1961 | Barritt | |
| 3,207,373 | A * | 9/1965 | Dannenmann | 222/651 |
| 5,176,297 | A * | 1/1993 | Mooney et al. | 222/325 |
| 5,839,454 | A * | 11/1998 | Matz | 134/57 D |
| 6,282,927 | B1 * | 9/2001 | Wunderlich et al. | 68/3 R |
| 6,804,974 | B1 * | 10/2004 | Voglewede et al. | 62/264 |
| 2002/0185162 | A1 * | 12/2002 | Rosenbauer et al. | 134/57 D |
| 2005/0126608 | A1 * | 6/2005 | DeWeerd et al. | 134/56 D |

FOREIGN PATENT DOCUMENTS

| | | | |
|---|---|---|---|
| DE | 1 585 754 | | 11/1970 |
| DE | 3513640 | A1 * | 10/1986 |
| EP | 0 611 843 | A1 | 8/1994 |
| EP | 1 002 494 | A1 | 5/2000 |
| EP | 1 319 360 | A1 | 6/2003 |
| FR | 2486794 | A * | 1/1982 |
| GB | 2 321 590 | A | 8/1998 |
| WO | 03/054276 | A1 | 7/2003 |

* cited by examiner

*Primary Examiner*—Michael Kornakov
*Assistant Examiner*—Eric Golightly
(74) *Attorney, Agent, or Firm*—Pearne & Gordon LLP

(57) ABSTRACT

The invention concerns a device and a method of adding rinse aids to a home appliance containing liquid, especially a household dishwasher, with a main tub (1), which has a service opening (4) to put the things to be washed into the main tub (1), whereby the device includes at least one dispensing unit (6) to hold and dispense the rinse aid. The dispensing unit (6) is placed in the main tub (1), whereby at least part of the dispensing unit (6) is placed so it can move or is movable and can be pulled out of the main tub (1), at least partly, in the direction of the service opening (4).

26 Claims, 2 Drawing Sheets

DEVICE FOR AND A METHOD OF ADDING RINSE AIDS TO A HOME APPLIANCE CONTAINING LIQUIDS

The invention concerns a device for and a method of adding rinse aids to a home appliance containing liquids, especially a household dishwasher.

Modern household dishwashers, for example, can run various programs, which can be selected by the operator. The programs can include several wash cycles, like for example, the pre-wash cycle, the main wash cycle and the rinse cycle. In each wash cycle, a working liquid circulating in the dishwasher preferably has an agent added to it, for example a detergent or a rinse aid, for example a clear rinse or brightener.

Usually a metering device is provided to add the agents to the working liquid in a home appliance containing liquids. The metering device can be filled with the agent, which is then itself rinsed out of the metering device at the appropriate time, most often by the working liquid.

On household dishwashers, the metering device is usually built into a latch-type service door that closes the service opening where the dishes are put in. One simple embodiment of such a metering device is disclosed in EP 0 190 795 A2, for example. A detergent dispenser with a lid is placed in the service door of the dishwasher and has two detergent chambers for the pre-wash and the main wash. One of the two chambers has a dispensing hole in the closed lid, so the detergents can be metered into the working liquid separately from one another, first with the lid closed and then with the lid open. A plurality of other metering devices built into the service door of home appliances is also known from the state of the art. For example, like the feed device described in DE 36 23 027 A1, besides the chambers for detergent, there can also be a chamber for a clear rinse.

Metering or dispensing devices for other rinse aids in household dishwashing machines are known that are placed on a basket or spray arm or built into the spray arm. Thus, for example, CH 386 643 A discloses a spray arm designed to hold detergents or rinse aids. In the spray arm, there is at least one chamber that can be filled with the rinse aid from the outside and is connected via bore holes to the inside of the spray arm, so that some of the working liquid can flow through the chamber and can carry out the rinse aid.

One variation of a metering device placed on the spray arm is described in DE 692 02 303 T2. In it, a detergent dispenser, which basically has a shell-shaped element, can hold the detergent and is hydraulically connected to the inlet line, so that some of the detergent can be rinsed out by the circulated water, with the upper spray arm connected tightly and able to rotate. The detergent dispenser can be taken off the spray arm, at least in part, to make it easier to fill.

However, the metering devices described above have the disadvantage that when the metering device is filled, the working conditions are not optimal. Especially when the operator is filling a metering chamber in the service door of the home appliance with the rinse aids, as described in EP 0 190 795 A2 and DE 36 23 027 A1, he/she must always bend forward or down during the whole filling process. The detergent dispenser that can be taken off the spray arm (DE 692 02 303 T2) makes it easier to fill, but if the basket next to the detergent dispenser is fully loaded, the dishes can get in the way of putting the removable part of the detergent dispenser back on. This device, like the one described in CH 386 643 A, is not ergonomically optimized.

What is more, the program cycle design is limited on metering devices whose metering functionality is directly connected to other process or function parameters like spray arm functionality or temperature range.

The problem of the invention is to provide a device for and a method of adding rinse aids to a home appliance containing liquids, in which the above-mentioned disadvantages in the state of the art are overcome, at least partly, or at least reduced.

This problem is solved with a device with the features in Patent claim 1 and with a method with the features in Patent claim 27. Advantageous embodiments and improvements can be found in the claims dependent on claims 1 and 27.

The device in claim 1 for adding rinse aids to a home appliance containing liquids, especially a household dishwasher, with a main tub, which has a service opening for putting things to be cleaned into the main tub, has at least one dispensing unit to hold and dispense the rinse aid, whereby the dispensing unit is placed in the main tub and whereby at least part of the dispensing unit is movable or arranged so it can move and can be pulled out of the main tub, at least partly, in the direction of the service opening.

The main tub of the home appliance containing liquids serves to hold the things to be cleaned, for example, dishes, and has a floor, ceiling and side walls that connect the floor to the ceiling. As a rule, on the front side wall of the main tub, there is a service opening that can be closed with a latch-type service door. The things to be cleaned can be put into the main tub through the service opening. In the closed main tub, the things to be washed are then brought in contact with a working liquid or detergent circulated in the home appliance, as a rule water, with rinse aids added.

During the wash cycle, the rinse aids in the storage chambers, including for example various detergents or clear rinses, are dispensed into the main tub by the dispensing unit. To fill it with rinse aids, at least part of the dispensing unit can be pulled out of the main tub or pulled forward, at least partly, like a drawer. The rinse aids can then be flushed out of the dispensing unit, for example with a liquid, or simply fall into the main tub.

In its basic form, the dispensing unit is preferably basically cuboid or box-shaped. The basic cuboid shape may have cutouts or recesses with any geometric shape if there is an advantage to installing it in the main tub or to the functionality of the dispensing unit. However, the dispensing unit can also have any other basic geometric shape that is appropriate, for example basically spherical, wedge-shaped, cylindrical or prism-shaped that is different from the cuboid. The dispensing unit can also be made of one or several pieces. If the dispensing unit has several parts, for example, one part can be placed in the main tub so it cannot move and potentially contain different functional elements of the dispensing unit, and another part for filling rinse aids from the main tub is designed to be able to be pulled out or forward. All parts of the dispensing unit are preferably combined in one compact unit.

With the method in claim 27 of adding rinse aids to a home appliance containing liquids, especially a household dishwasher, with a main tub that has a service opening for putting things to be cleaned into the main tub, especially using the device in claim 1 or one of the claims dependent on claim 1, at least part of a dispensing unit in the main tub is pulled out of the main tub, at least partly, in the direction of the service opening, and filled with at least one rinse aid, and the dispensing unit dispenses at least some of at least one rinse aid into the working liquid and/or into the main tub during one work cycle.

One main advantage of the device and the method in the invention is that the dispensing unit can be pulled at least partly out of the main tub and can therefore be filled very comfortably with the respective rinse aids. The dispensing unit is preferably placed in the main tub so that the operator need not bend forward, stoop over or crouch down when filling the dispensing unit. The filled dispensing unit is then pushed back into the main tub. This then is very fast and easy to do, if the dispensing unit is not pulled completely out of the main tub for filling or can be taken out.

Another advantage of the device is that the dispensing unit can be connected relatively easily to a hydraulic circuit or a circuit for circulating the working liquid in the home appliance, since it is arranged as a compact unit inside the main tub. Unlike the most common [way of] rinsing the detergent out of the metering chamber with a spray of water, this allows some control over how the liquid is added and distributed in the various areas of the dispensing unit. Powdered rinse aids in particular can be completely dissolved this way and carried off. The program cycles can also be designed in a variety of ways.

Because various functional elements can be built into the compact dispensing unit, the system costs are also reduced.

In one especially advantageous embodiment of the device in the invention, the dispensing unit can be at least partly removed from the main tub. It can then be taken anywhere desired to be filled, for example for to make it cleaner to fill, especially with powdered rinse aids or rinse aids pressed from powder. That way, the dispensing unit is also easier to clean, if that is desired.

It is a special advantage if the dispensing unit is placed on one inside wall of the main tub so it can move, at least in part, or is movable. Then the placement of the things to be cleaned in the main tub will not be affected by the dispensing unit in the main tub, and the space in the main tub can be utilized in the best possible way. It is especially preferred if the dispensing unit is arranged so it can move, at least in part, or is movable, on one interior side of the ceiling of the main tub, since besides particularly good accessibility, this can make the best use of the space. In this case, the rinse aid is dispensed from the top down toward the floor, so the rinse aid is distributed relatively evenly over the main tub and can therefore be utilized optimally. But it is also conceivable to place the dispensing unit on one side wall of the main tub so it is at least partly movable or moving. Here, it should be provided as much as possible at a site where it is easy to pull out and fill, but not interfere with the working of the potential built-ins in the main tub, like the basket for the dishes or the spray arm.

It is also advantageous if on the inside wall of the main tub on which the dispensing unit is placed, and/or on the dispensing unit, at least one means of attaching the dispensing unit and/or at least one means of guiding at least part of the dispensing unit in the main tub is or are provided. The means can preferably include at least one guide rail provided on the inside of the wall and/or on the dispensing unit. The guide rails can be designed, for example, so that corresponding guide rails provided on the wall and on the dispensing unit fit into one another. Means of attaching and guiding the dispensing unit, for example, also include holders placed on the inside of the wall that can be used to guide the dispensing unit at the same time. Very simple such holders are square or U-shaped, for example.

In one particularly convenient embodiment, at least one handle is provided on the dispensing unit to move the dispensing unit and/or at least one means is provided that holds the dispensing unit in place when it is pushed in. The handle can be either set on the dispensing unit or be designed as a depression in the dispensing unit. The means of holding the dispensing unit in place when pushed in can be, for example, a bar that must be released before it can be pulled out. In one simple embodiment, the means can also include simply at least one appropriate nose or shaft that fits into a corresponding depression (notch or groove), so that the dispensing unit can be moved at a certain tensile force, but cannot fall out if the home appliance is tipped, for example.

Preferably, the dispensing unit includes at least one storage chamber for at least one rinse aid. The dispensing unit and/or at least one storage chamber then preferably have at least one fill hole for at least one rinse aid and at least one dispensing hole for at least one rinse aid.

At least one fill hole is preferably aligned toward the wall of the main tub on which the dispensing unit is placed. Depending on the shape and installation site of the dispensing unit, another arrangement of the fill holes may be advantageous, however.

At least one dispensing hole is preferably aligned toward the main tub, especially in a direction perpendicular to the wall of the main tub on which the dispensing unit is placed. If several dispensing holes are provided, they can also be made in various directions. It is also true for the dispensing holes that the appropriate dispensing direction or the direction in which the dispensing holes will be made will be selected depending on the shape of the dispensing unit and where it is installed.

In one especially preferred embodiment, the dispensing unit is placed on the inside of the ceiling of the main tub, whereby at least one dispensing hole and at least one fill hole are each arranged on opposite sides of the dispensing unit and/or the storage chamber and basically point away from one another and whereby the fill hole is aligned toward the inside of the ceiling.

At least one part of the dispensing unit can preferably be pulled out of the main tub so far that at least one fill hole is free. This makes it possible to fill the dispensing unit and/or at least one storage chamber with no problem.

It is especially advantageous if at least one storage chamber is designed so that it can hold the maximum amount of rinse aid for one work cycle, especially a wash cycle, or the maximum amount of rinse aid for several work cycles. One work cycle includes all wash cycles in a work program.

It is especially advantageous if the dispensing unit has at least two storage chambers to hold rinse aids, especially at least one storage chamber to hold a detergent and at least one storage chamber to hold a rinse aid, for example a clear rinse.

The dispensing unit can preferably be designed so that at least one storage chamber for the rinse aid can hold a predetermined amount of rinse aid for several work cycles and at least one storage chamber for detergent can hold a predetermined amount of rinse aid for a rinse cycle. For this, at least one storage chamber for the rinse aid, for example, can also have a larger volume than at least one storage chamber for the detergent. The fact that the storage chamber for the rinse aid can hold a predetermined amount of rinse aid for several work cycles has the advantage that it need not be refilled with the rinse aid at each rinse cycle, when frequently only a relatively small amount is needed per rinse cycle. In this way the rinse aid can also be metered more precisely.

In one especially preferred embodiment of the device in the invention, the dispensing unit is connected to a hydraulic circuit or a circuit circulating a working liquid in the home appliance, so that at least some of the circulated working liquid or rinse liquid flows through the dispensing unit. The connection to the hydraulic circuit can be made in a simple way by having the working liquid flow out of a feed on or in the wall of the main tub through a hole or nozzle on or in the wall of the main tub and flow into the fill hole of the dispensing unit.

But it can also be advantageous if the dispensing unit is connected to the hydraulic circuit by means of a connection so it is either separable or not separable. Hoses, for example, can be provided as the means of connection, can be connected to the dispensing unit and can take some of the working liquid out of the circulation circuit to the dispensing unit. The dispensing unit is then generally not separable from the hose, so that when the dispensing unit is pulled out, the hose comes with it. One way of connecting the dispensing unit to the circulation circuit so it is separable would be, for example, a separable plug-in connection or coupling whereby the dispensing unit is connected when pushed into a pipe from the circulation circuit. All other known and appropriate means of connection to a hydraulic circuit can be used.

Preferably, at least one liquid-distribution device is provided, whereby the working liquid is distributed to individual areas in the dispensing unit and/or whereby the amount of liquid and/or the distribution of the liquid can be controlled. At least one liquid distribution device can be built into the dispensing unit, for example.

In one advantageous embodiment, a liquid distribution device for metering the working liquid is provided in at least one storage chamber. The storage chamber is preferably designed so that the rinse aid is carried out of the storage chamber at least partly through the dispensing hole by the working liquid metered in.

For example, a powdered detergent can first be acted on by the working liquid and be converted into the liquid state before it is flushed into the washing chamber. In this way, the detergent is almost completely carried out of the storage chamber, and the detergent is also distributed in a more even concentration in the main tub.

It can also be a special advantage if the dispensing unit has at least one spray unit to spray at least some of the circulating working liquid in the main tub, especially at least one spray nozzle and/or at least one spray arm. In this way, the working liquid can be evenly distributed from above onto the things to be cleaned, which increases the cleaning effectiveness of the home appliance. To supply at least one spray unit with the working liquid, the dispensing unit preferably has at least one channel and/or at least one means, which can be a hose line or a pipe, for example.

It is a special advantage if a liquid distribution device for metering the working liquid is provided in at least one spray unit. Individual spray nozzles can thus be controlled in a targeted way so that, for example, more or less working liquid can be sprayed on [the dishes] depending on the degree to which they are soiled. The liquid distribution device for metering the working liquid in at least one spray unit preferably corresponds to the liquid distribution device for metering the working liquid in at least one storage chamber. In this case, only one control unit for distributing liquid is necessary.

In one advantageous embodiment, a sensor is built into the dispensing unit to monitor the fill level in a storage chamber. The dispensing unit includes at least one display unit, especially at least one LED or at least one display, and/or at least one unit for transmitting signals to a control unit, so the fill level detected in the storage chamber can be displayed on a control panel of the home appliance or used to control a work cycle.

It is also an advantage if the dispensing unit includes at least one device for monitoring the loading of the main tub and/or for monitoring the rotation of the spray arm. An optical sensor system can be used as the device for monitoring the loading, for example, and can determine the amount of dishes in the dishwasher. The data detected on the loading of the main tub and/or on the spray arm rotation can also be used to control a work cycle.

In one convenient embodiment, the dispensing unit also has a lamp to light up the inside of the main tub.

The home appliance containing liquid, especially a household dishwasher, in claim 26 includes a device for adding rinse aids, especially according to claim 1 or one of the claims dependent on claim 1.

In the process of adding rinse aids to a home appliance containing water, it is a special advantage if a working liquid flows through the dispensing unit and at least one rinse aid is flushed into the main tub, at least in part, with the working liquid. That way, the rinse aid can be completely dissolved and evenly distributed in the main tub.

It can also be an advantage if at least some of at least one rinse aid falls out of the dispensing unit into the main tub due to the force of gravity. In particular, powdered rinse aids or rinse aids pressed from powder, for example detergent tablets, can be easily metered in this way.

The invention will be described in detail below using examples of embodiment with reference to the attached drawings.

Corresponding parts and sizes have the same reference numbers in FIGS. 1 to 5.

Figure 1:
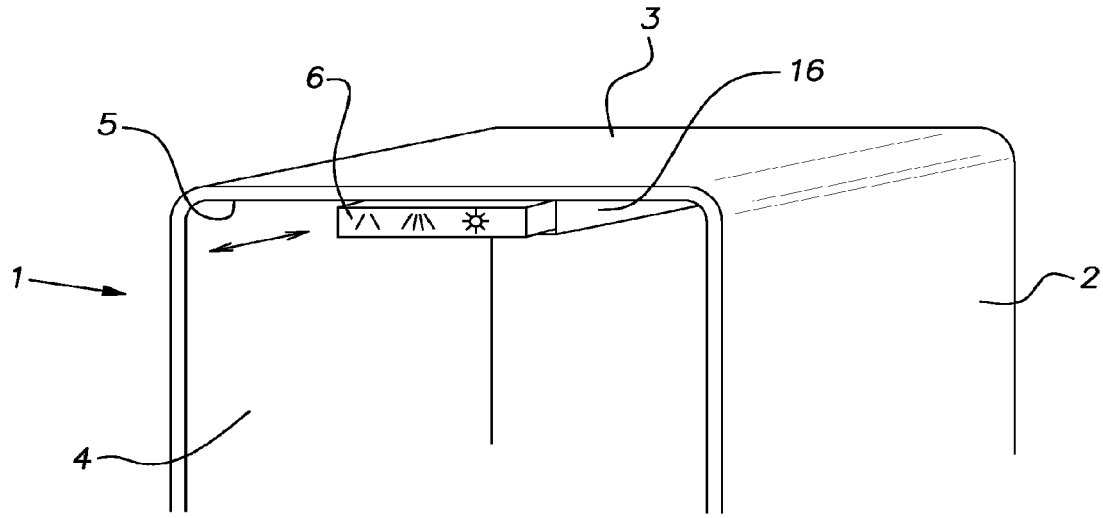
FIG. 1 shows an advantageous embodiment of the device in the invention.

FIG. 1 is a schematic view of a simple, advantageous embodiment of the device in the invention. In the main tub 1, shown only partially, of a household dishwasher with side walls 2, a ceiling 3 and a service opening 4, on one interior side 5 of the ceiling, a dispensing unit 6 for the device in the invention is arranged so it can move. The dispensing unit 6 is held and moved by guide rails 16 on the inside 5 of the ceiling 3 of the main tub 1. The dispensing unit 6 shown in FIG. 1 is able to be pulled out of the main tub 1 or forward in the direction of the service opening 4 of the main tub 1 and can be pushed back in again (shown by a directional arrow).

The dispensing unit 6 of another embodiment of the device in the invention (not shown in FIGS. 1 to 5) could also include several parts, at least one of which can be pulled out of the main tub 1 in the direction of the service opening 4. In it, it would also be conceivable that a stationary part of the dispensing unit 6 is offset behind at least one moving part of the dispensing unit 6, i.e., in the direction of the service opening 4 pointing away or laterally next to at least one moving part of the dispensing unit 6, i.e., offset in a direction parallel to the service opening 4, on the inside ceiling of the main tub 1. The stationary part and the moving part of the dispensing unit 6 would then preferably be placed adjacent to one another, so as to create a compact unit. Then, for example, the stationary part could include one or more functional elements, like the liquid distribution device, sensors or a lighting unit, whereby at least one moving part is provided with at least one storage chamber for a rinse aid.

Figure 2:
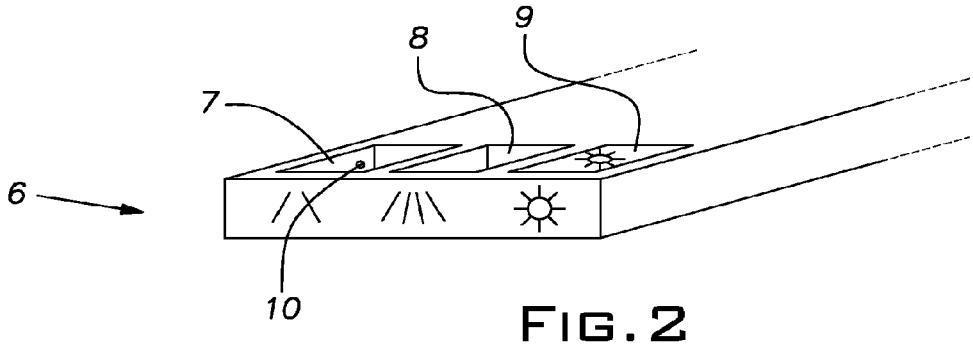
FIG. 2 shows a perspective detailed view of a dispensing unit of the device in FIG. 1.
Figure 3:
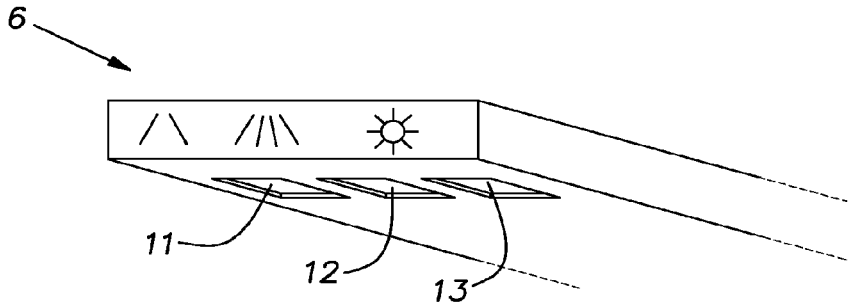
FIG. 3 shows another perspective detailed view of the dispensing unit in FIG. 2.

FIGS. 2 and 3 are detailed schematic views of a compact, one-piece dispensing unit 6 according to FIG. 1. FIG. 2 is a perspective view of the side of the dispensing unit 6 facing the inside 5 of the ceiling 3. The dispensing unit 6 includes three storage chambers 10, which can be filled with a rinse aid through an accompanying fill hole 7, 8, 9. For filling, the dispensing unit 6 is pulled out of the main tub 1 until the fill holes 7, 8, 9 are freely accessible. The dispensing unit 6 can be filled with various rinse aids with no trouble. The device can also be designed so that the dispensing unit 6 can be completely taken out of the main tub to make it possible to clean the storage chambers 10, for example, if this should be desired.

The storage chambers 10 with the fill holes 7 and 8 are provided for adding a detergent, especially for a pre-wash phase (fill hole 7) and for a main wash phase (fill hole 8). The storage chambers 10 with fill holes 7 and 8 are designed in the dispensing unit 6 shown in FIG. 2 so that they can hold detergent for only one work or wash cycle. The accompanying storage chamber 10 can be filled with another rinse aid, preferably a clear rinse, through fill hole 9. Storage chamber 10 is designed so that it can hold rinse aids for several work cycles, and only some of the rinse aid is dispensed in each work cycle.

FIG. 3 is a perspective view of the side of the dispensing unit 6 facing the main tub 1. On this side of the dispensing unit 6 are the dispensing holes 11, 12, 13 assigned to the respective storage chambers 10, which are aligned perpendicularly here from the inside 5 of the ceiling back into the main tub 1.

When the dispensing unit 6 is pushed in, during the work cycle, at least some of the working liquid, normally water, which circulates in a hydraulic circuit in the household dishwasher, is fed into the dispensing unit 6, especially into the storage chambers 10, so that they have at least some flowing through them. The addition of the working liquid can be controlled by the liquid distribution device (not shown here); especially the amount and the area that must flow through the storage chambers 10, for example, can be set. The working liquid can be taken out of the hydraulic circuit easily by having the working liquid flow out through a respective hole (not shown) in the ceiling 3 of the main tub 1 and flow into the fill holes 7, 8 or 9 of the dispensing unit below. But means of feeding it, like hoses or pipes, can also be provided, which are connected to the hydraulic circuit and the dispensing unit and take the working liquid into the respective area.

The working liquid flows out of the dispensing holes 11, 12, 13 with a certain amount of rinse aid. In the dispensing unit 6 shown in FIG. 3, a detergent preferably comes out of dispensing hole 11 for the pre-wash cycle, a detergent out dispensing hole 12 for the main wash cycle and a rinse aid out dispensing hole 13 with the working liquid.

Figure 4:
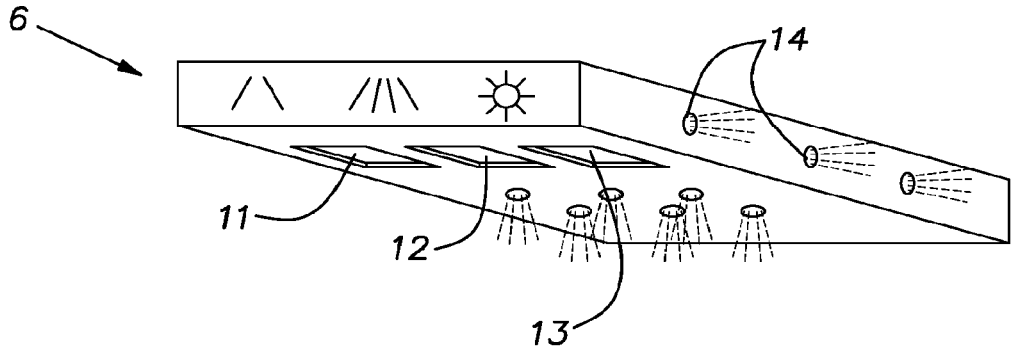
FIG. 4 shows a perspective view of another altered dispensing unit for the device in FIG. 1.
Figure 5:
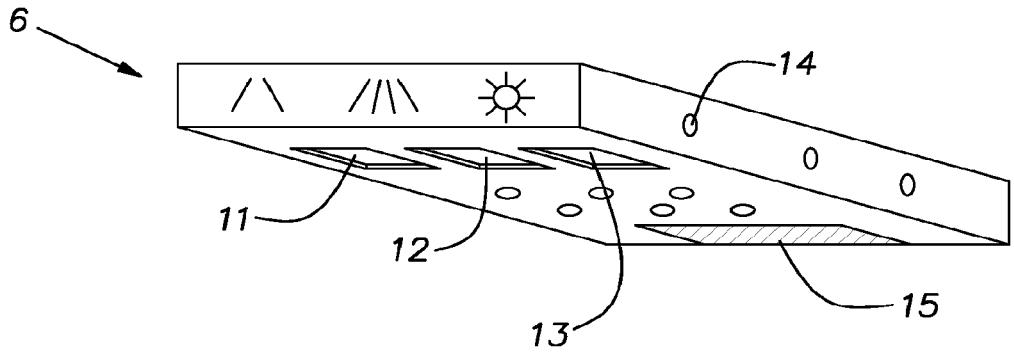
FIG. 5 shows a perspective view of another altered dispensing unit for the device in FIG. 1.

FIG. 4 shows a dispensing unit 6, which basically corresponds to the dispensing unit 6 shown in FIG. 3, with the difference that the dispensing unit 6 shown in FIG. 4 also has spray nozzles 14 through which working liquid can also be sprayed into the main tub 1. As shown in FIG. 4, the spray nozzles 14 can be placed on different sides of the dispensing unit 6 in order to achieve a wide, even distribution of liquid. The angle at which the spray nozzles 14 spray the stream of liquid into the main tub 1 (alignment of spray nozzles 14) and the angle of aperture of the spray stream (shape and size of spray nozzles 14) can be selected depending on the respective requirement, and the dispensing unit 6 can be designed accordingly.

To supply the spray nozzles with working liquid, there is preferably a channel, hose line or pipe (not shown) in the dispensing unit 6. The connection to the hydraulic circuit can also be made with a hose or pipe. The distribution of the liquid through the individual spray nozzles 14 can be set with a liquid distribution device device, as described above. The dispensing unit shown in FIG. 5 basically corresponds to the dispensing unit 6 shown in FIG. 4 and also has a lighting unit 15 to light up the inside of the main tub when it is being filled with dishes or emptied.

LIST OF REFERENCES

1 Main tub
2 Side wall
3 Ceiling
4 Service opening
5 Inside of ceiling
6 Dispensing unit
7,8,9 Fill holes
10 Storage chamber
11,12,13 Dispensing hole
14 Spray nozzle
15 Lighting unit
16 Guide rail

The invention claimed is:

1. A device for adding auxiliary agents to a home appliance that runs with liquid, with a) a main tub (1), which has a plurality of fixed walls and a service opening (4) to put things to be cleaned into the main tub, the fixed walls including a plurality of side walls (2) and a ceiling (3), and the service opening (4) being closed by a moveable door, the device including b) at least one dispensing unit (6) to hold and dispense auxiliary agents, c) whereby the dispensing unit (6) is placed inside the main tub (1) and is operably attached to at least one of the fixed walls, d) whereby at least part of the dispensing unit (6) is placed so it can move or is movable, and e) can be moved, at least partly, beyond said at least one fixed wall to which the dispensing unit remains operably attached while being moved and out of the main tub (1) in the direction of the service opening (4) to enable at least one auxiliary agent to be added to the dispensing unit (6).

2. The device in claim 1, whereby the dispensing unit (6) can, at least partly, be taken out of the main tub (1).

3. The device according to claim 1, whereby on said at least one fixed wall of the main tub (1) to which the dispensing unit (6) operably attached, and/or on the dispensing unit (6), at least one means of attaching the dispensing unit (6) and/or at least one means of guiding at least part of the dispensing unit (6) in the main tub (1) is/are provided, said at least one means of guiding comprising at least one guide rail (16).

4. The device according to claim 1, whereby at least one handle is provided on the dispensing unit (6) to move the dispensing unit (6) and/or at least one means is provided that holds the dispensing unit (6) in place when it is pushed in.

5. The device according to claim 1, whereby the dispensing unit (6) includes at least one storage chamber (10) to hold at least one auxiliary agent.

6. The device according to claim 1, whereby the dispensing unit (6) and/or at least one storage chamber (10) include at least one fill hole (7, 8, 9) for at least one auxiliary agent and at least one dispensing hole (11, 12, 13) for at least one auxiliary agent.

7. The device in claim 6, whereby at least one fill hole (7, 8, 9) is directed toward said at least one fixed wall of the main tub (1), to which the dispensing unit (6) is operably attached.

8. The device in claim 6, whereby at least one dispensing hole (11, 12, 13) is directed toward the main tub (1) in a direction basically perpendicular to said at least one fixed wall of the main tub (1) to which the dispensing unit (6) is operably attached.

9. The device according to claim 1, whereby at least one part of the dispensing unit (6) can be pulled out of the main tub (1) far enough to expose at least one fill hole (7, 8, 9).

10. The device according to claim 1, whereby at least one storage chamber (10) is designed so that it can hold maximally a predetermined amount of auxiliary agent for a work cycle or maximally a predetermined amount of auxiliary agent for several work cycles.

11. The device according to claim 1, whereby the dispensing unit (6) includes at least two storage chambers (10) to hold auxiliary agents, said at least two storage chambers (10) comprising at least one storage chamber (10) to hold a detergent and at least one storage chamber (10) to hold a washing auxiliary agent.

12. The device in claim 11, whereby said at least one storage chamber (10) to hold a washing auxiliary agent can hold a predetermined amount of auxiliary agent for several work cycles and at least one storage chamber (10) for the detergent can hold a predetermined amount of auxiliary agent for a wash cycle.

13. The device according to claim 1, whereby the dispensing unit (6) is connected to a hydraulic circuit in the home appliance, so that at least some of a working liquid flows through the dispensing unit (6).

14. The device according to claim 1, whereby at least one liquid distribution device is provided, through which the working liquid is distributed to the individual areas in the dispensing unit (6) and/or through which the amount of liquid and/or the distribution of liquid can be controlled.

15. The device in claim 14, whereby the at least one liquid distribution device is built into the dispensing unit (6).

16. The device according to claim 1, whereby a liquid-distribution device is provided for metering the working liquid in at least one storage chamber (10).

17. The device in claim 16, whereby the storage chamber (10) is designed so that the auxiliary agent is carried out of the storage chamber (10), at least partly, through the dispensing hole (11, 12, 13) by the working liquid which is added.

18. The device according to claim 1, whereby the dispensing unit (6) includes at least one spray unit (14) for spraying at least some of the working liquid circulated in the main tub (1), said at least one spray unit (14) comprising at least one spray nozzle (14) and/or one spray arm.

19. The device in claim 18, whereby at least one channel and/or at least one means is/are provided in the dispensing unit (6) to supply the at least one spray unit (14) with working liquid.

20. The device according to claim 5, whereby a liquid distribution device is provided to meter the working liquid into at least one spray unit (14), which corresponds to the liquid distribution device for metering the working liquid into the at least one storage chamber (10).

21. The device according to claim 1, whereby at least one sensor is built into the dispensing unit (6) to monitor the fill level in a storage chamber(10).

22. The device according to claim 1, whereby the dispensing unit (6) includes at least one sensor to monitor the loading of the main tub (1) and/or to monitor a rotation of a spray arm.

23. The device according to claim 1, whereby the dispensing unit (6) has at least one display unit comprising at least one LED or at least one display, and/or at least one unit for transmitting signals to a control unit.

24. The device according to claim 1, whereby the dispensing unit (6) includes a lighting unit (15) to light up the main tub (1).

25. The device according to claim 1, wherein the service opening (4) is located in a front wall between two of said side walls (2).

26. The device according to claim 1, wherein said at least one fixed wall of the main tub (1) to which the dispensing unit (6) is operably attached is the ceiling (3).

* * * * *

UNITED STATES PATENT AND TRADEMARK OFFICE

CERTIFICATE OF CORRECTION

PATENT NO. : 7,578,303 B2
APPLICATION NO. : 11/003802
DATED : August 25, 2009
INVENTOR(S) : Daume et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 991 days.

Signed and Sealed this

Seventh Day of September, 2010

David J. Kappos

David J. Kappos
*Director of the United States Patent and Trademark Office*